US010781814B2

(12) United States Patent
Plisch et al.

(10) Patent No.: US 10,781,814 B2
(45) Date of Patent: Sep. 22, 2020

(54) PISTON PUMP COMPRISING A PISTON WITH A PROFILED FRONT FACE

(71) Applicant: Robert Bosch GmbH, Stuttgart (DE)

(72) Inventors: Andreas Plisch, Marbach (DE); Jurij Giesler, Korntal (DE); Siamend Flo, Schwieberdingen (DE); Thorsten Allgeier, Untergruppenbach (DE); Walter Maeurer, Korntal-Muenchingen (DE); Lena Maren Baessler, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 456 days.

(21) Appl. No.: 15/534,518

(22) PCT Filed: Sep. 7, 2015

(86) PCT No.: PCT/EP2015/070361
§ 371 (c)(1),
(2) Date: Jun. 9, 2017

(87) PCT Pub. No.: WO2016/091408
PCT Pub. Date: Jun. 16, 2016

(65) Prior Publication Data

US 2017/0314550 A1 Nov. 2, 2017

(30) Foreign Application Priority Data

Dec. 10, 2014 (DE) ..... 10 2014 225 412

(51) Int. Cl.
*F04B 53/02* (2006.01)
*F04B 17/04* (2006.01)
*F04B 53/00* (2006.01)

(52) U.S. Cl.
CPC ..... *F04B 53/02* (2013.01); *F04B 17/044* (2013.01); *F04B 53/008* (2013.01)

(58) Field of Classification Search
CPC combination set(s) only.
See application file for complete search history.

(56) References Cited

U.S. PATENT DOCUMENTS 1,233,693 A * 7/1917 Niebling ..... F16K 15/08 137/516.17
4,021,151 A 5/1977 Barthalon
5,131,818 A 7/1992 Wittkop et al.
(Continued)

FOREIGN PATENT DOCUMENTS

CN 1846059 A 10/2006
CN 101956621 A 1/2011
(Continued)

OTHER PUBLICATIONS

International Search Report for Application No. PCT/EP2015/070361 dated Nov. 19, 2015 (English Translation, 3 pages).

*Primary Examiner* — Patrick Hamo
*Assistant Examiner* — David N Brandt
(74) *Attorney, Agent, or Firm* — Michael Best & Friedrich LLP

(57) ABSTRACT

The invention relates to a piston pump, in particular for injection systems for motorized two-wheeled vehicles and/or for motorized three-wheeled vehicles, having a compression chamber, a piston, an inlet valve, and an outlet valve. A fluid can flow into the compression chamber via the inlet valve, and the fluid can flow out of the compression chamber via the outlet valve. A region in the form of a channel, which is arranged fluidically upstream of the outlet valve, in particular directly upstream of the outlet valve, has a cross-section which is reduced compared to a compression chamber region at a distance from the outlet valve. The invention is characterized in that a piston end face facing the channel has a region which can be immersed into the channel.

20 Claims, 2 Drawing Sheets

(56) References Cited

U.S. PATENT DOCUMENTS 5,149,254 A * 9/1992 Riffe ..... F04B 39/0005 417/569
5,816,783 A * 10/1998 Oshima ..... F01L 25/04 417/415
6,953,157 B2 * 10/2005 Boehland ..... F02M 47/027 239/124
7,380,493 B2 * 6/2008 Park ..... F04B 39/0005 92/233
2007/0020123 A1 * 1/2007 Meyer ..... F04B 43/02 417/413.1
2009/0110575 A1 * 4/2009 Munakata ..... F02M 59/48 417/437
2009/0217909 A1 * 9/2009 Allen ..... F02M 63/0026 123/436
2010/0152714 A1 * 6/2010 Haase ..... A61M 5/14216 604/891.1
2010/0300407 A1 * 12/2010 Ravenhill ..... F02M 35/10222 123/468
2010/0316515 A1 * 12/2010 Hamada ..... F04B 39/023 417/437
2011/0164991 A1 * 7/2011 Baumbach ..... F04B 49/10 417/63
2016/0160790 A1 * 6/2016 Pursifull ..... F02M 59/027 123/294

FOREIGN PATENT DOCUMENTS

| | | | |
|---|---|---|---|
| CN | 101970851 | A | 2/2011 |
| JP | H0248401 | A | 2/1990 |
| JP | H11223175 | A | 8/1999 |
| JP | 3192319 | B2 | 7/2001 |
| JP | 2003214275 | A | 7/2003 |
| JP | 2006046304 | A | 2/2006 |
| JP | 2006152881 | A | 6/2006 |
| JP | 2011106324 | A | 6/2011 |
| JP | 2011132940 | A | 7/2011 |
| WO | 2006116343 | | 11/2006 |

* cited by examiner

PISTON PUMP COMPRISING A PISTON WITH A PROFILED FRONT FACE

BACKGROUND OF THE INVENTION

The invention starts from a piston pump.

Currently known piston pumps operate on the following principle: the piston, which is arranged and can be moved in a cylinder, is moved in the direction of an armature plate arranged on the rear side of the cylinder, e.g. by means of a magnetic field produced by a solenoid. During this process, a fluid, e.g. a fuel, is drawn via an inlet valve into a compression chamber, which is arranged between the inlet valve in the cylinder bottom and the piston. If the magnetic field is switched off, a spring, for example, which is arranged between the piston and the armature plate, pushes the piston back in the direction of the initial position and, in the process, compresses the fluid and pushes it out of the compression chamber via an outlet valve.

In many embodiments of the piston pump, especially in piston pumps with simultaneous inflow and outflow, there is the problem that there is a volume region in the compression chamber itself or directly adjoining the compression chamber in which the fluid present therein cannot be compressed or displaced or cannot be adequately compressed or displaced by the piston movement. This volume region is referred to as the dead volume. The size of the dead volume affects the efficiency of the piston pump.

SUMMARY OF THE INVENTION

The piston pump according to the invention is designed to reduce the dead space volume and thus to increase the efficiency of the piston pump.

For this purpose, it is envisaged according to the invention that the piston has, on its side facing a channel, a region which can be made to enter into the channel. In particular, this region is made to enter into the channel at least temporarily during a pump cycle. Typically, the channel is arranged fluidically between the compression chamber and the outlet valve, especially if the outlet valve and the inlet valve of the piston pump are arranged coaxially with one another. In particular, the channel is arranged directly upstream of the outlet valve and typically has a smaller diameter than a compression region at a distance from the outlet valve. By virtue of the region, the piston has a section which is designed to enter the channel, particularly during the compression phase or displacement phase of the pump cycle, and to compress or displace the fluid present there. As a result, the dead volume of the piston pump is reduced and the efficiency of the piston pump is increased.

In an advantageous development, it is envisaged that the outlet valve, the channel and the piston with the region are arranged along a common axis. The axis preferably lies in the direction of movement of the piston. This ensures that the piston pump has a particularly high efficiency since, during the compression phase, when the fluid leaves the compression chamber through the outlet valve, the fluid can flow in the same direction in which the piston is moving to leave the compression chamber.

It has proven advantageous if the region is formed as a projection on the end face of the piston which faces the channel. The piston itself can have a geometry which is matched, in particular optimized, to the geometry of the compression chamber, while the region or projection is matched or optimized to the geometry of the channel, in particular having the same geometry, e.g. cross section and/or length and/or diameter. In this context, "optimized" means that the piston is configured in such a way in relation to the compression chamber that, on the one hand, the piston pump has a high effective cross section and, on the other hand, the piston has low wear—caused by friction with the side walls of the compression chamber for example—and thus a long life.

For example, the region or the projection can have a cylindrical, conical or cuboidal geometry. The projection is preferably formed as an annular shoulder on the piston end face.

In a preferred development, the region or projection has a length M which is not less than 5% of the length L of the channel, in particular not less than 25% of the length of the channel and/or not greater than 95% of the length L of the channel. The length M of the region or projection is the distance from the end face of the piston, on which the region or projection is arranged, perpendicularly as far as the end face of the region or projection which faces the channel. This ensures that the region has a sufficiently great length M to effectively reduce the dead volume in the channel.

In addition or as an alternative, it is envisaged that the region or projection has at least an entry depth T into the channel, wherein the entry depth T is at least 5% of the length L of the channel, in particular at least 15% of the length L of the channel and/or not greater than 95% of the length L of the channel. This ensures that the region has a sufficiently great entry depth T to effectively reduce the dead volume in the channel, even if the region or projection cannot enter the channel with its complete length M.

The channel preferably has a smaller diameter than the compression chamber. The diameter of the channel corresponds to at least 5% and/or at most 30% of the diameter of the compression chamber.

In an advantageous embodiment, it is envisaged that the region is a boss. The boss is formed during the production of the piston by machining in a turning process, in accordance with DIN 6785. Normally, the boss is removed from the piston end face to ensure that the piston has a smooth end face. The boss is a suitable means of reducing the dead volume. In addition, there is also the effect that it is possible to dispense with the working step of removing the boss from the piston during the production of the piston and the piston pump and thus that the production of the piston pump is simplified.

In principle, the region or projection can advantageously be formed integrally with the piston, e.g. in the form of the boss, or as a multi-part assembly with the piston. In the case of a multi-part design, the region is connected materially, e.g. by means of welding, to the piston.

In the case of the integral configuration, there is the advantage that there is no need for an extra material joint between the region and the piston. Fundamentally, additional joints can always be weak points in mechanically stressed components.

The multi-part configuration provides the advantage that the region can be produced independently of the piston. Depending on the intended use and configuration of the piston pump, the piston can be combined with a corresponding region matched to the channel and the intended purpose.

DETAILED DESCRIPTION

Figure 1A:
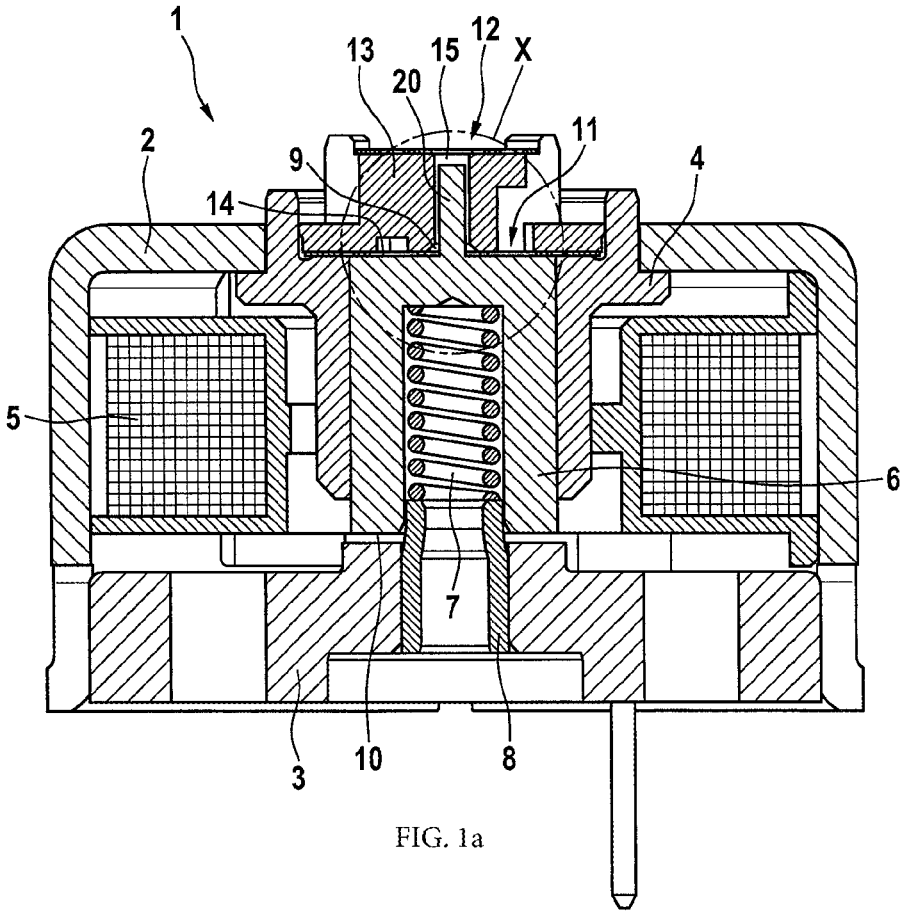
FIGS. 1*a* and 1*b* show a first example of a piston pump according to the invention
Figure 1B:
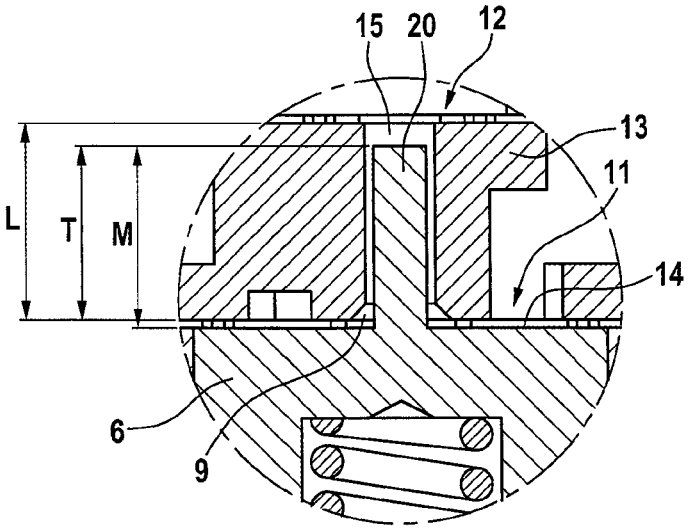
Figure 2A:
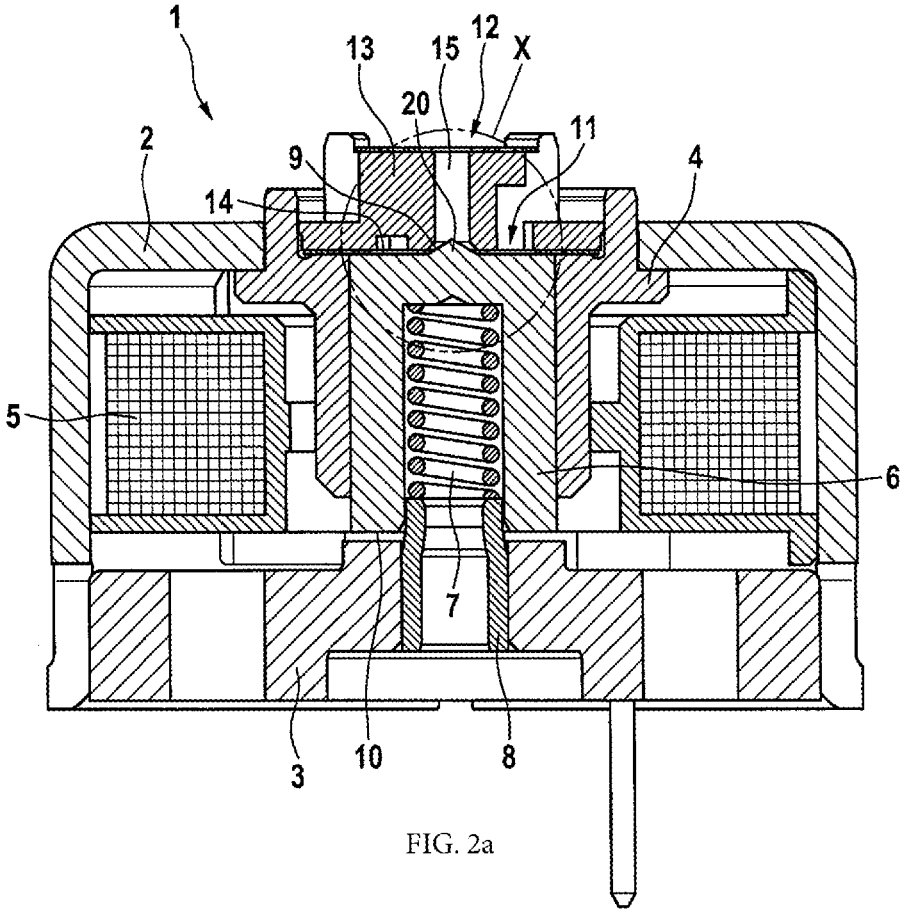
FIGS. 2*a* and 2*b* show a second example of a piston pump according to the invention
Figure 2B:
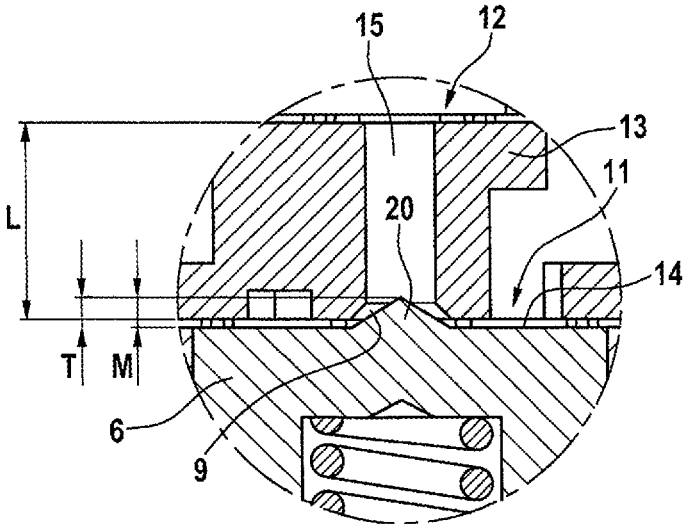

Two illustrative embodiments of the piston pump 1 according to the invention are shown in FIG. 1 and FIG. 2. The two illustrative embodiments differ in the precise configuration of the region 20 arranged on the end face 12 of the piston 6 which faces the channel 15. Part a) of each of the two figures shows a schematic illustration of a piston pump 1, wherein the basic construction of the piston pump 1 is the same in both illustrative embodiments. Part b) of each of the two figures shows an enlargement of the region X marked by a circle in part a) of the figures.

The basic construction of the piston pump 1 is described below. The piston pump 1 has a housing 2, an armature plate 3 and, for example, a solenoid 5 or solenoid set arranged in the housing 2. A cylinder 4 is arranged in the solenoid 5. A movable piston 6 is, in turn, arranged in the cylinder 4. The magnetic field produced by the solenoid 5 moves the piston 6 in the direction of the armature plate 3. On its side facing the piston 6, the armature plate 3 has a stop, against which the piston 6 strikes when the solenoid 5 is energized, i.e. when the magnetic field is switched on. The side of the piston 6 which faces the armature plate 3 is referred to as the piston rear side 10. The surface by means of which the piston rear side 10 touches the stop of the armature plate 3 when the magnetic field is switched on is referred to as the contact surface. The end face 14 of the piston 6 situated opposite the piston rear side 10 is also referred to as the piston front side.

A piston spring 7 is arranged between the piston 6 and the armature plate 3. The piston spring 7 is fixed on the side thereof facing the armature plate 3 by a spring holder 8. The piston spring 7 can be arranged partially or completely within the piston 6 or in a cavity arranged in the piston 6. The piston rear side 10 has an opening, through which the piston spring 7 projects from the piston. The piston spring 7 is compressed owing to the movement of the piston in the direction of the armature plate 3. After the magnetic field is switched off, the piston spring 7 pushes the piston 6 back in the opposite direction.

An inlet valve 11 and an outlet valve 12 are furthermore arranged in the cylinder 4, in particular in the cylinder bottom. The cylinder 4 is delimited by the armature plate 3 on one side and by the cylinder bottom on the opposite side. A compression chamber 9 is arranged within the cylinder 4. The compression chamber 9 is delimited by the cylinder walls, the inlet valve 11 and the piston 6.

The inlet valve 11 and/or the outlet valve 12 can be designed as Belleville springs. The inlet valve 11 and the outlet valve 12 and thus also the inlet and the outlet are arranged on the same side of the cylinder 4 or of the compression chamber 9. The compression chamber 9 is arranged fluidically between the inlet valve 11 and the outlet valve 12. A valve body 13 is arranged between the inlet valve 11 and the outlet valve 12. A channel 15 is formed within the valve body 13. Typically, the length of the channel 15 corresponds to the length of the valve body 13. The outlet valve 12 is connected to the compression chamber 9 by means of the channel 15, thus allowing the fluid to flow from the compression chamber 9 to the outlet valve 12 via the channel 15.

Fuel lines, via which a fuel is drawn into the compression chamber 9 within the cylinder 4 from a tank through the inlet valve 11 owing to the vacuum, are not shown. The vacuum in the cylinder 6 or in the compression chamber 9 is produced by the movement of the piston 6 in the direction of the armature plate 3. The fuel is forced from the piston 6 to an injection valve via further fuel lines and the outlet valve 12.

In the first illustrative embodiment, which is shown in FIG. 1, the region 20 is designed as a cylindrical protrusion. The region 20 has a length M of 93% of the length L of the channel 15. The entry depth T of the region 20 in the channel 15 is 90% of the length L of the channel 15. The fact that the diameter of the region 20 is matched to the diameter of the channel 15, i.e. the difference between the two diameters of the region 20 and the channel 15 is less than 10% of the diameter of the channel 15, ensures that the dead volume in the channel 15 is effectively minimized and, at the same time, as little friction as possible is produced between the region and the channel wall.

In the second illustrative embodiment, which is shown in FIG. 2, the region is designed as a boss. The boss has a length M of 15% of the length L of the channel and an entry depth T of 11.5% of the length L of the channel.

The invention claimed is:

1. A piston pump (1) comprising a compression chamber (9), a housing (2), a piston (6) in the housing (2), an inlet valve (11), an outlet valve (12), and a solenoid (5) for generating a magnetic field that moves the piston (6), wherein the solenoid (5) is arranged in the housing (2) and around the piston (6), wherein the fluid can flow into the compression chamber (9) via the inlet valve (11), and the fluid can flow out of the compression chamber (9) via the outlet valve (12), and wherein a channel (15) forms a channel region arranged fluidically downstream of the compression chamber (9) and upstream of the outlet valve (12), the channel region having a cross section which is reduced in comparison with a region of the compression chamber (9) which is at a distance from the outlet valve (12), characterized in that an end face (14) of the piston (6) which faces the channel (15) has a piston region (20), wherein the piston region (20) can be made to enter into the channel (15), wherein movement of the piston region (20) in the channel (15) toward the outlet valve (12) forces the fluid to flow out of the channel (15) via the outlet valve (12), and wherein the piston pump is configured for use in injection systems for motorized two-wheeled vehicles and/or for motorized three-wheeled vehicles.

2. The piston pump (1) as claimed in claim 1, characterized in that the piston region (20) is a projection on the end face (14) of the piston (6) which faces the channel (15).

3. The piston pump (1) as claimed in claim 1, characterized in that the piston region (20) has a cylindrical, conical or cuboidal geometry.

4. The piston pump (1) as claimed in claim 1, characterized in that the piston region (20) has a length M of not less than 10% of a length L of the channel (15), wherein the length M of the piston region (20) is a distance from the end face (14) of the piston (6), on which the piston region (20) is perpendicularly arranged, to an end face of the piston region (20) which faces the channel (15).

5. The piston pump (1) as claimed in claim 1, characterized in that the piston region (20) has at least an entry depth T into the channel (15), wherein the entry depth T is at least 5% of a length L of the channel (15).

6. The piston pump (1) as claimed in claim 1, characterized in that the piston region (20) has a same geometrical configuration as the channel (15).

7. The piston pump (1) as claimed in claim 1, characterized in that the piston region (20) is a boss.

8. The piston pump (1) as claimed in claim 1, characterized in that the piston region (20) is formed integrally with the piston (6).

9. The piston pump (1) as claimed in claim 1, characterized in that the piston region (20) is connected materially to the piston (6).

10. The piston pump (1) as claimed in claim 1, wherein the channel region is arranged directly upstream of the outlet valve (12).

11. The piston pump (1) as claimed in claim 1, characterized in that the piston region (20) has at least an entry depth T into the channel (15), wherein the entry depth T is at least 15% of a length L of the channel (15).

12. The piston pump (1) as claimed in claim 1, characterized in that the piston region (20) is connected materially, by welding, to the piston (6).

13. The piston pump (1) as claimed in claim 1, characterized in that the piston region (20) has a cylindrical geometry.

14. The piston pump (1) as claimed in claim 1, characterized in that the piston region (20) has a conical geometry.

15. The piston pump (1) as claimed in claim 1, wherein a piston spring (7) is arranged in a cavity disposed in the piston (6).

16. The piston pump (1) as claimed in claim 15, wherein the piston spring (7) pushes the piston (6) in a direction such that the piston region (20) moves further into the channel (15), and wherein the magnetic field moves the piston (6) in an opposite direction such that the piston (6) compresses the piston spring (7).

17. The piston pump (1) as claimed in claim 1, wherein the magnetic field moves the piston (6) towards an armature plate (3).

18. The piston pump (1) as claimed in claim 17, wherein the piston (6) strikes the armature plate (3) when the solenoid (5) is energized.

19. The piston pump (1) as claimed in claim 1, characterized in that the piston region (20) has a cuboidal geometry.

20. A fuel injector comprising a compression chamber (9), a piston (6), an inlet valve (11), and an outlet valve (12), wherein a fluid can flow into the compression chamber (9) via the inlet valve (11), and the fluid can flow out of the compression chamber (9) via the outlet valve (12), and wherein a channel (15) forms a channel region arranged fluidically downstream of the compression chamber (9) and upstream of the outlet valve (12), the channel region having a cross section which is reduced in comparison with a region of the compression chamber (9) which is at a distance from the outlet valve (12), characterized in that an end face (14) of the piston (6) which faces the channel (15) has a piston region (20), wherein the piston region (20) can be made to enter into the channel (15), wherein movement of the piston region (20) in the channel (15) toward the outlet valve (12) forces the fluid to flow out of the channel (15) via the outlet valve (12), and wherein the fuel injector is configured for use in injection systems for motorized two-wheeled vehicles and/or for motorized three-wheeled vehicles.

* * * * *